US009570254B2

(12) United States Patent
Kropf et al.

(10) Patent No.: US 9,570,254 B2
(45) Date of Patent: Feb. 14, 2017

(54) PORTABLE ELECTRONIC USER DEVICE

(71) Applicant: Continental Automotive GmbH, Hannover (DE)

(72) Inventors: Thomas Kropf, Brunn (DE); Wolfgang Kaiser, Höchstädt I.F. (DE); Florian Schweiger, Kehlheim (DE); Rudolf Renner, Nürnberg (DE)

(73) Assignee: Continental Automotive GmbH, Hanover (DE)

( * ) Notice: Subject to any disclaimer, the term of this patent is extended or adjusted under 35 U.S.C. 154(b) by 0 days.

(21) Appl. No.: 14/778,657

(22) PCT Filed: Mar. 19, 2014

(86) PCT No.: PCT/EP2014/055474

§ 371 (c)(1),
(2) Date: Sep. 21, 2015

(87) PCT Pub. No.: WO2014/154539

PCT Pub. Date: Oct. 2, 2014

(65) Prior Publication Data

US 2016/0055991 A1 Feb. 25, 2016

(30) Foreign Application Priority Data

Mar. 28, 2013 (DE) ..... 10 2013 205 689

(51) Int. Cl.
*H01H 13/70* (2006.01)
*G07C 9/00* (2006.01)

(52) U.S. Cl.
CPC ..... *H01H 13/7006* (2013.01); *G07C 9/00944* (2013.01); *H01H 2221/03* (2013.01);
(Continued)

(58) Field of Classification Search
CPC ..... H01H 2221/03; H01H 2223/003; H01H 2231/032; H01H 13/7006; H01H 2221/036; H01H 2231/026; G07C 9/00944
(Continued)

(56) References Cited

U.S. PATENT DOCUMENTS 4,892,988 A * 1/1990 Ishii ..... H01H 13/7006 200/516
6,180,895 B1 * 1/2001 Hutchinson ..... H01H 13/702 200/314
(Continued)

FOREIGN PATENT DOCUMENTS

CN 201518285 6/2010
CN 102206966 10/2011
(Continued)

OTHER PUBLICATIONS

German Examination Report for German Application No. 10 2013 205 689.3 mailed Sep. 5, 2013.
International Search Report for International Application No. PCT/EP2014/055474 mailed Aug. 13, 2014.
Chinese Office Action dated Aug. 22, 2016 for Chinese Application No. 201480019041.3, including English translation, 22 pages.

*Primary Examiner* — Edwin A. Leon
(74) *Attorney, Agent, or Firm* — RatnerPrestia

(57) ABSTRACT

A portable electronic user device, in the form of an electronic key, having an inherently rigid button for activation by a user. The portable electronic user device further has a flexibly deformable membrane including a first side having at least one support section on which the at least one button is supported via the plunger, and an actuating section, separate from the at least one support section, for receiving and forwarding an actuation of the button to an electrical switch element. There is a rigid frame which bears the membrane on a second side opposite the first side, wherein, in the assembled state, having the membrane in the region of the at least one support section, the frame has at least one
(Continued)

breakout, via which the membrane is moveable by the plunger upon activating the at least one button and, in dependence on the size and/or the shape of the breakout, provides a force for resetting the button. As a result of the separation of the generating of the reset force on the support sections movable by the first breakouts and the switch function in the region of the activation section, there is great freedom in the design of the portable electronic user device, wherein reliable triggering of the switch element is always ensured.

13 Claims, 4 Drawing Sheets

(52) U.S. Cl.
CPC . *H01H 2221/036* (2013.01); *H01H 2223/003* (2013.01); *H01H 2231/026* (2013.01); *H01H 2231/032* (2013.01)

(58) Field of Classification Search
USPC ..... 200/5 A, 341, 293, 296, 511, 517
See application file for complete search history.

(56) References Cited

U.S. PATENT DOCUMENTS

| | | | | |
|---|---|---|---|---|
| 6,765,159 | B1 | 7/2004 | Uebelein | |
| 7,056,042 | B2 * | 6/2006 | Pihlaja ..... | G06F 3/0202 150/154 |
| 7,705,258 | B2 | 4/2010 | Geldmacher | |
| 8,003,901 | B2 | 8/2011 | Sugimoto | |
| 8,836,486 | B2 | 9/2014 | Saito | |
| 8,921,721 | B2 | 12/2014 | Senzaki | |
| 2009/0020402 | A1 | 1/2009 | Ichikawa | |
| 2011/0241830 | A1 | 10/2011 | Saito | |
| 2012/0111709 | A1 | 5/2012 | Senzaki | |
| 2013/0141212 | A1 | 6/2013 | Pickering | |

FOREIGN PATENT DOCUMENTS

| | | |
|---|---|---|
| CN | 102918569 | 2/2013 |
| DE | 102005001002 | 7/2006 |
| DE | 102005014563 | 9/2006 |
| JP | 2006202691 | 8/2006 |
| JP | 2009016069 | 1/2009 |
| JP | 20122104325 | 5/2012 |

* cited by examiner

PORTABLE ELECTRONIC USER DEVICE

CROSS REFERENCE TO RELATED APPLICATIONS

This application is the U.S. National Phase Application of PCT International Application PCT/EP2014/055474, filed Mar. 19, 2014, which claims priority to German Patent Application No. 10 2013 205 689.3, filed Mar. 28, 2013, the contents of such applications being incorporated by reference herein.

FIELD OF THE INVENTION

The present invention relates to a portable electronic user device, in particular in the form of an electronic key for a vehicle.

BACKGROUND OF THE INVENTION

Nowadays, there is a need for portable electronic user devices, such as electronic keys or radio keys for vehicles for example, which are intended to allow any desired design variants with any desired button shapes, depending on customer requirements. Furthermore, efforts are increasingly being made to reduce the dimensions, in particular the overall height, of the portable electronic user devices in order to improve the carrying comfort. One problem in this respect is that, on account of the variety of designs, in particular of the buttons which are to be operated by a user, it is necessary to ensure that, when these buttons are operated, a corresponding switching element is also triggered in order to execute a corresponding function, such as the transmission of a door locking signal for a vehicle.

SUMMARY OF THE INVENTION

Therefore, an aspect of the present invention provides a portable electronic user device with a minimized overall height which ensures reliable triggering of a function.

In this case, a portable electronic user device, in particular in the form of an electronic key for a vehicle, comprises the following features. Said portable electronic user device has at least one inherently dimensionally rigid button for operation by a user. In this case, the inherently dimensionally rigid button can, for example, be composed of a hard plastic, in particular of a thermoplastic. Furthermore, the portable electronic user device comprises a flexibly deformable or elastic diaphragm comprising a first side having at least one bearing section on which the at least one button is mounted by means of a tappet, and also an operating section, which is separate from the at least one bearing section, for receiving and passing on an operation of the button to an electrical switching element. In this case, the diaphragm can be formed from rubber. The switching element can be designed, for example, as a so-called "microswitch" or a pushbutton. Furthermore, the portable electronic user device has an inherently dimensionally rigid frame which supports the diaphragm on a second side which is situated opposite the first side, wherein the frame (in the state in which it is assembled with the diaphragm) has at least one first aperture in the region of the at least one bearing section, it being possible for the diaphragm to be moved through said first aperture (by means of the tappet) when the at least one button is operated and said diaphragm providing a force for returning the button depending on the size and/or the shape of the aperture. In other words, the diaphragm, the shape of which is changed in the region of the at least one bearing section by means of the tappet through the at least one first aperture, provides a spring force which acts in the direction of the button and consequently on the finger of a user, which finger is operating the button. If, for example, the size of the aperture or the diameter of the aperture is small in comparison to the tappet diameter, only relatively little material of the diaphragm is moved through the first aperture when the button is operated, wherein this little material is deformed to a great extent and a high spring force or return force is achieved quickly as a result. If, in contrast, the bearing section is large in comparison to the tappet, a relatively large amount of diaphragm material is moved through the first aperture in comparison to the first case just described, and therefore this material is deformed only to a slight extent and therefore the return force also remains low.

Owing to the separation of the switching function in the region of the operating section and the return function or force/travel function in the region of the at least one bearing section, the present invention therefore allows a high degree of freedom in terms of design when providing the bearing sections, and it is therefore ensured that a button operation is reliably passed on to the electrical switching element by virtue of optimized mounting of the at least one button on the bearing section or the bearing sections. In particular, the haptics properties when operating a button, in particular a haptics characteristic curve, can be set depending on customer requirements by virtue of the size and/or shape of the first apertures which are provided beneath the bearing sections. It is also possible to achieve a low installation space height by separating the return and switching elements or "arranging" said return and switching elements "next to one another".

According to an advantageous refinement, the respective tappet is formed by a projection on the first side of the diaphragm in the region of the at least one bearing section. A projection of this kind can also be called a force dome or force tappert since the at least one button is mounted on it, and it passes on the return force of the diaphragm in the region of the bearing section to the button. In this case, the overall height of the force tappet can prespecify the maximum operating travel in the direction of the button which is to be mounted, it being possible for the button, when it is operated by a user to cover, said maximum operating travel until it butts against the dimensionally rigid frame. It is also possible for a printed circuit board to be arranged beneath a first aperture within the frame, the force tappet or the bearing section which is deformed by said force tappet butting against said printed circuit board when the button is operated. A so-called "over force protection" (protection against excessively high action of force) can be realized in the two ways mentioned.

According to a further refinement, the tappet is formed by a projection of the at least one button which interacts mechanically with the at least one bearing section of the diaphragm (in the state in which the at least one button and the diaphragm are assembled). Furthermore, it is also feasible to form a mechanical connection between the projection of the diaphragm and the projection of the at least one button, in which mechanical connection one of the projections has a receiving section (a recess) on that section which faces the other projection, it being possible for the other projection to be received in said receiving section. Providing the receptacle in one of the projections ensures that the two projections maintain their position in relation to one another, in particular in the event of the button being operated off-center by a user.

According to a further advantageous refinement, the frame has a second aperture in the region of the fastening section of the diaphragm (in the state in which the frame is assembled with the diaphragm), it being possible for the diaphragm to be moved through said second aperture in order to pass on a button operation to the electrical switching element. In this case, the diameter of the second aperture can be larger or very much larger than the diameter of the at least one first aperture since said second aperture serves only to pass on the button operation and less for setting a haptics characteristic curve. Owing to the provision of a frame and a diaphragm which is associated with said frame and can act on components within the frame via apertures, a space which is sealed off from the outside can be created within the frame, the components, such as electronic components, printed circuit board etc., which are situated in the space being accommodated in a manner protected against environmental influences. The diaphragm therefore serves as a sealing element.

According to a further refinement, the diaphragm has, on the first side, a second projection in the region of the operating section in order to provide an operative mechanical connection to the at least one button and/or the at least one button has a second projection for providing an operative mechanical connection to the operating section of the diaphragm. Owing to this respective second projection, the button can establish an operative mechanical connection to the diaphragm at the beginning of a button operation or starting from a specific travel covered in the direction of the diaphragm, and the diaphragm can move in the direction of an electronic switching element which is situated beneath the operating section, in order to trigger said electronic switching element given a specific operating travel.

According to a further refinement, the at least one button has an operating surface, wherein, in the state in which the at least one button and the diaphragm are assembled, the operating section of the diaphragm is situated beneath the geometric center of the operating surface. In other words, the operating section is congruent to the geometric center of the operating surface (in the state in which the at least one button and the diaphragm are assembled). In this way, reliable triggering of the electronic switching element when the corresponding button is operated is further improved.

For the purpose of optimized mounting of the button and yet further improved reliable triggering of the switching element, the diaphragm can have at least three bearing sections which span an area beneath the operating surface of the at least one button. In the case of substantially polygonal buttons, it is preferred to form at least as many bearing sections as corresponds to the number of corners of the buttons. In particular, it is advantageous when the area which is spanned by the bearing sections is as large as possible and corresponds to the operating surface of the button which is mounted above it. In this case, it may be advantageous to provide the respective bearing sections in the corner regions of the button which is situated above it.

According to a further refinement, the diaphragm is fastened onto the frame by adhesive bonding, friction welding, by clips, by a laser welding method and/or an ultrasonic welding method. This prevents the diaphragm from slipping in relation to the frame and improves the reliability of triggering of the electrical switching element when the button is operated. However, it is also possible for the diaphragm and the frame to be in the form of a two-component injection-molded element, in which the diaphragm forms the soft component and the frame forms the hard component of the two-component injection-molded element. Very precise and efficient combination of the two components is achieved in this way, wherein movement in relation to the respective other component is further prevented.

According to a further refinement, the electrical switching element is provided on a printed circuit board which is arranged within the frame in such a way that the electrical switching element is situated beneath the second aperture. As already mentioned above, the frame can be used not only to mount the diaphragm, but also as a holding element for further components, in particular electronic components which are to be protected against forces created in the surrounding area or other influences within the frame.

BRIEF DESCRIPTION OF THE DRAWINGS

Exemplary embodiments of the present invention will now be explained in greater detail below with reference to the appended drawings, in which:

FIGS. 1A-1B 1) being mounted on said switch housing;

DETAILED DESCRIPTION OF THE PREFERRED EMBODIMENTS

A portable electronic user device is now intended to be described in the text which follows using the example of an electronic key for vehicles. In this case, an electronic key for a vehicle generally has an electronics part which is fed by an energy store, such as a battery or a rechargeable battery. In addition, an electronic key of this kind has, for communicating with a controller of the vehicle, a transceiver device for exchanging radio signals. Therefore, a code which is stored in an electronic memory of the key is sent to the vehicle in a unidirectional manner in the case of an active access system, or exchanged between the electronic key and the vehicle in a bidirectional interchanging code method as part of a passive access system. After each positive authentication, the controller in the vehicle unlocks the locks, and therefore the vehicle user can open the doors. This authentication process can be started either by pressing a button (as part of an active access system) on the electronic key or, in the case of vehicles with a passive access system, is triggered by the vehicle if said vehicle detects by means of sensors that a user or an electronic key is approaching. To this end, the vehicle user carries an electronic key with a keypad and possibly with an integrated mechanical emergency key. The sensitive electronics system is accommodated in a relatively hard plastic housing in order to be protected against moisture and mechanical influences.

As already mentioned, an electronic key can therefore firstly comprise the function of unlocking (and also locking) the vehicle doors, but it can also be used as a remote control means for controlling other vehicle functions, such as for controlling an alarm system and for switching on an auxiliary heater etc. In order to control these functions remotely, the electronic key comprises one or more buttons which can be operated by a user in order to trigger the respective function. A particular challenge here is to ensure reliable triggering of a function.

To this end, an embodiment of an electronic key according to the invention is now intended to be described, said embodiment allowing reliable triggering of a function when a button on the electronic key is operated.

Figure 1A:
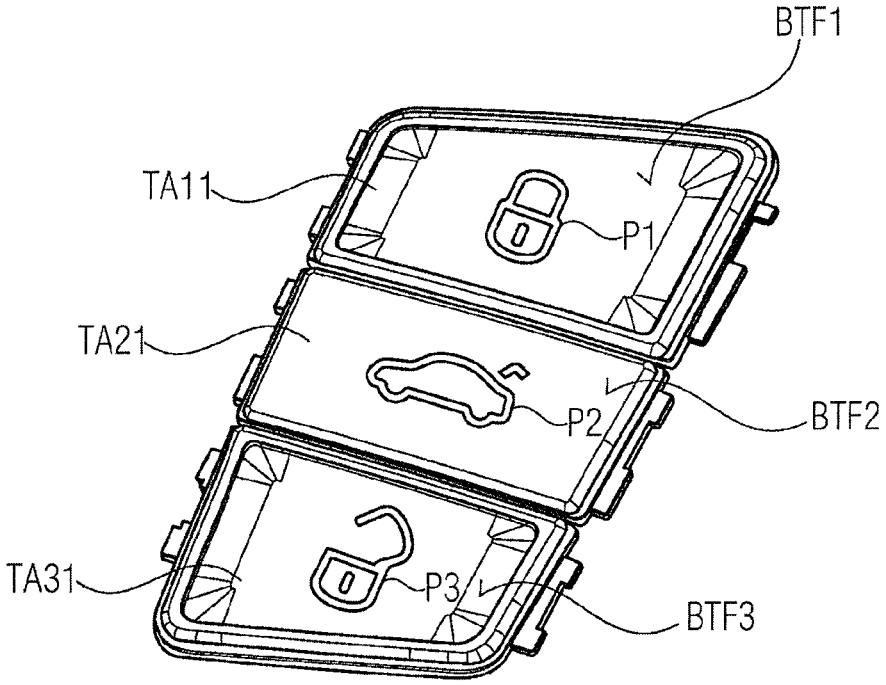
FIGS. 1A-1B show a schematic illustration of the buttons or button caps of the keypad of a portable electronic user device according to one embodiment of the invention.
Figure 1B:
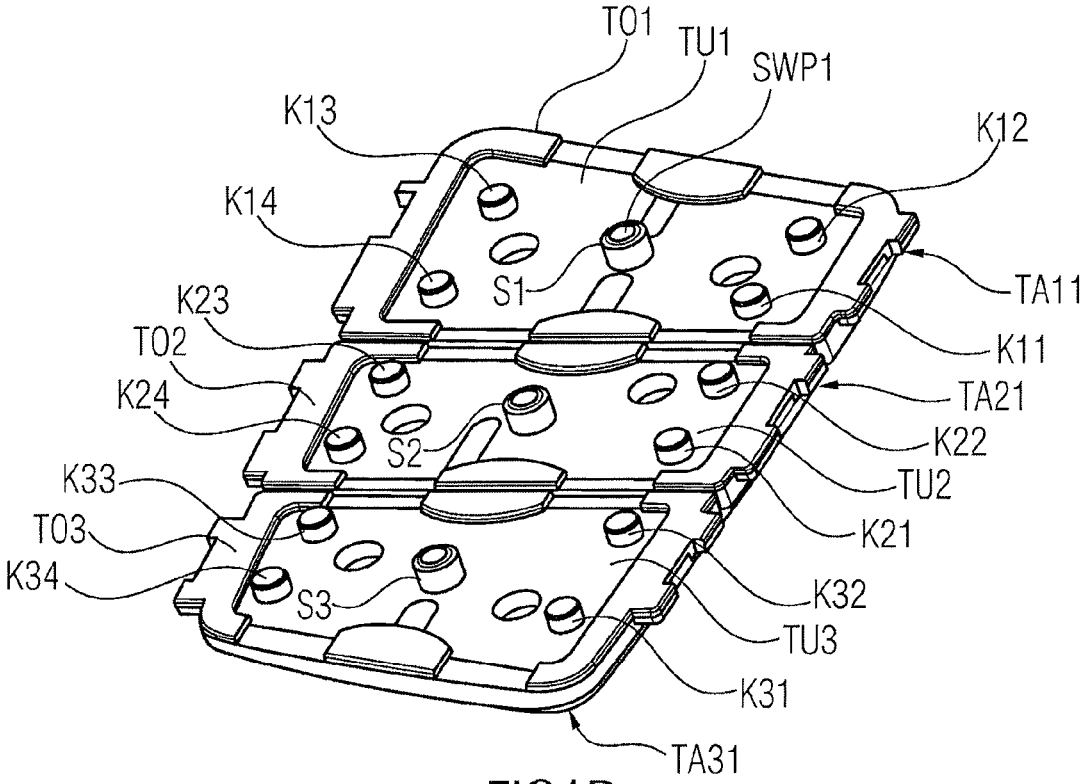

Reference will first be made to FIGS. 1A-1B which show a schematic view of the buttons of a keypad or an operator control panel of the electronic key. In this case, a front view of the buttons is illustrated in FIG. 1A, while a rear view of the buttons is shown in FIG. 1B. The keypad according to the illustration of FIG. 1A in this case comprises three buttons TA11, TA21, TA31 with corresponding function pictograms P1 (corresponding to a door locking function), P2 (corresponding to a trunk lid opening function) and P3 (corresponding to a door unlocking function), so that a user knows which function is triggered when he presses a particular button. To be precise, each of the buttons TA11, TA21, TA31 has a respective top button section TO1, TO2, TO3 on which the pictogram is provided and which provides the respective operating surface for operation by a user, and has a lower button section TU1, TU2, TU3 which, in the assembled state of the electronic key, faces the housing interior and has corresponding force or switching domes for mounting and operating an electrical switching element, as is shown in FIG. 1B. The respective upper and lower button sections are advantageously inherently dimensionally rigid and in particular are in the form a two-component injection-molded element.

As will be explained in even greater detail later, for example with reference to FIGS. 2A-2B, the buttons are mounted or supported by corresponding elastic or flexibly deformable diaphragms (such as the diaphragm M12 in FIGS. 2A-2B). To this end, the respective buttons TA11, TA21, TA31 or the lower button sections TU1, TU2, TU3 thereof have button-side projections or force domes (force tappets). In this case, said force domes are arranged beneath a respective operating surface BTF1, BTF2 and BTF3 of a respective button TA11, TA21 and TA31 in the state in which the buttons and the diaphragms are assembled. In particular, the force domes are arranged beneath or in the vicinity of the edge regions or, in the case of corner operating surfaces, in the region of the corners of the operating surfaces of the buttons, so that they span as large an area as possible, and therefore, even in the event of off-center operation of a button, the force of the user can be transmitted as far as possible to all of the force domes and therefore a predefined force characteristic curve or haptics characteristic curve can be achieved. As shown in FIG. 1B, the respective force domes are arranged substantially in the corner sections of the respective diaphragm and accordingly also beneath the corner sections of the operating surfaces of the keys TA11, TA21 and TA31, which surfaces are situated above them. In this case, the force domes are not positioned above an electrical switching element or not positioned in a switching axis.

In this case, the first button TA11 has the force domes K11, K12, K13 and K14, the second button TA21 has the force domes K21, K22, K23, K24. The third button TA31 has the force domes K31, K32, K33 and K34. In addition to the force domes which are in the form of projections, the respective buttons further have a projection which serves as a switching tappet, that is to say which passes on a button operation, to be precise a movement of the button in the direction of the tappet, to an electrical switching element which is situated beneath it. In order to reliably trigger a respective electrical switching element, the respective switching tappets S1, S2, S3 are arranged in the geometric center of the area which is spanned by the force domes. In particular, a geometric center of an area of this kind is also congruent to the geometric center of the operating surface which is situated on the opposite side of a respective button. By way of example, the switching tappet S1 should coincide with the geometric center SWP1 of the area which is spanned by the force domes K11, K12, K13 and K14.

Figure 2A:
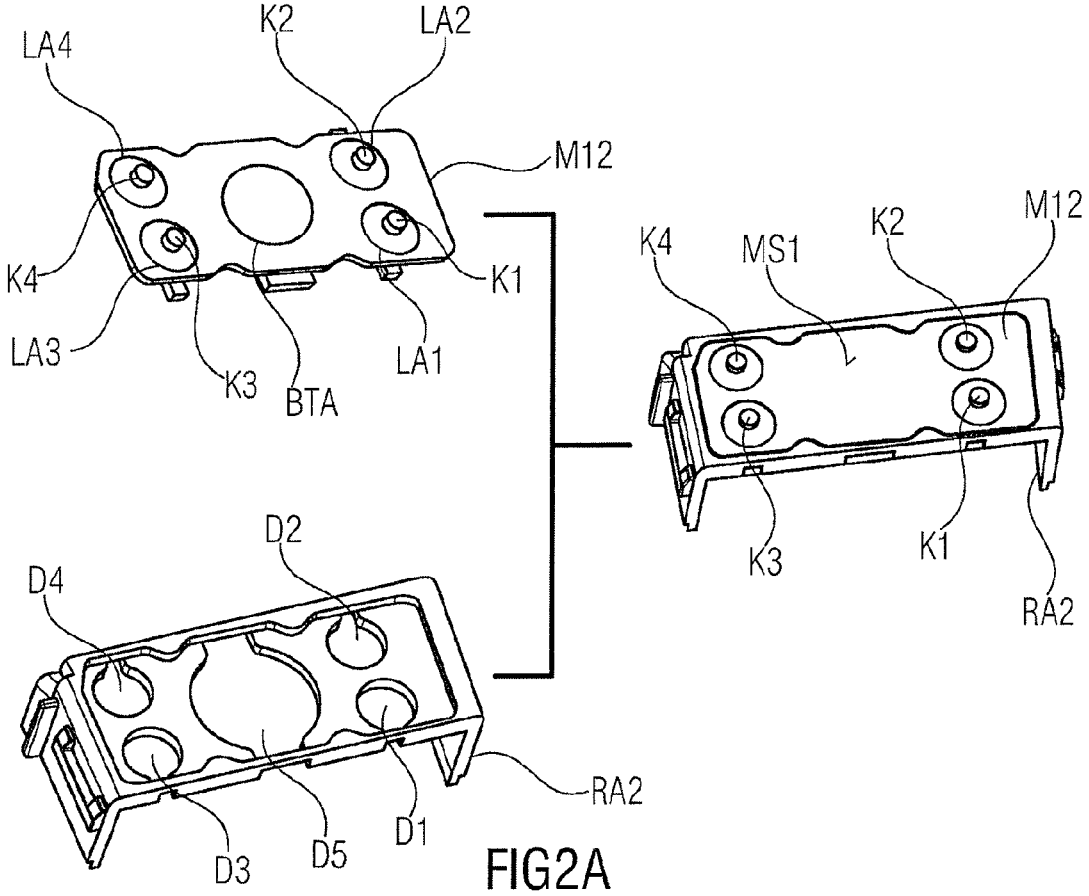
FIGS. 2A-2B show an exploded illustration of the important components of a switch housing of the portable electronic user device according to one embodiment of the invention, the buttons (cf.
Figure 2B:
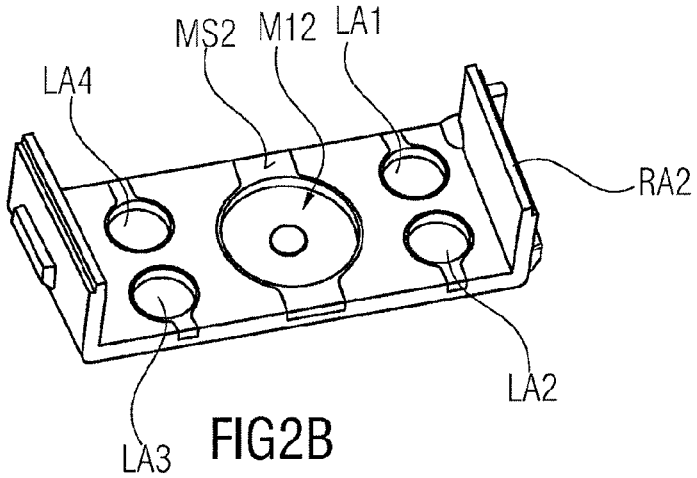

Reference will now be made to FIGS. 2A and 2B in which the principle according to the invention is intended to be explained with reference to an exploded illustration of the components of a switch housing as further components of the keypad of the electronic key (for better illustration only for one button of the keypad), specifically a diaphragm and correspondingly designed frame and also a combination of these components. Looking at FIG. 2A to begin with, a diaphragm M12 which can be assembled with a frame RA2 in order to realize a keypad of the electronic key is shown on the left-hand side of said figure. In this case, the two elements can, in particular, be in the form of a two-component injection-molded element in which the diaphragm forms the soft component and the frame forms the hard component of the two-component injection-molded element. The diaphragm M12 has, on a first side MS1, four force domes K1, K2, K3 and K4 on which a touch element (illustrated in FIGS. 1A-1B) can be mounted or supported. The respective force domes are situated in sections LA1, LA2, LA3 and LA4 of the diaphragm M12, said sections also being called bearing sections. An operating section BTA is shown in the center of the diaphragm, an electrical switching element being located beneath said operating section in the assembled state of the key. It should be noted that an electrical switching element is situated only beneath the operating section BTA but not below the bearing sections. It should further be noted that (although not shown in FIG. 2A) a raised portion or a projection in the form of a diaphragm-side upper switching tappet or switching dome which interacts with one of the button-side switching tappets S1, S2 and, respectively, S3 can likewise be formed on the first side MS1 in the region of the operating section BTA according to one possible refinement.

Looking now at the frame RA2, it is clear that, in a state in which the frame RA2 and the diaphragm M12 are assembled, first apertures D1, D2, D3 and D4 are situated beneath the respective bearing sections, and that a second aperture D5 is situated beneath the operating section BTA.

The assembled state of the two components is shown on the right-hand side of the figure, wherein the first side MS1 of the diaphragm M12 is averted from the frame RA2, the projections or the force domes K1, K2, K3 and K4 projecting away from said first side, in the assembled state.

FIG. 2B now shows the state in which the diaphragm M12 and the frame RA2 are assembled from the rear, wherein it is clear from said figure that the respective bearing sections LA1, LA2, LA3 and LA4 are adjacent to the first apertures D1, D2, D3 and D4 of the frame RA2, and the operating section BTA is adjacent to the second aperture D5. The diaphragm M12 is supported by the frame RA2 on a second side MS2 of the diaphragm M12 which is opposite the first side MS1. An operating projection BTV (or lower diaphragm-side switching tappet) can be seen in the center of the rear of the operating section BTA (that is to say on the second side MS2 of the diaphragm M12), it being possible to move said operating projection in the direction of a switching element which is situated beneath it when the button which is situated above it is operated, in order to trigger the switching element as can further be seen even better in FIG. 4. The position of the center axis of the operating projection BTV and of the center axis of a switching element, such as a microswitch, which is situated beneath it preferably coincide.

Figure 3A:
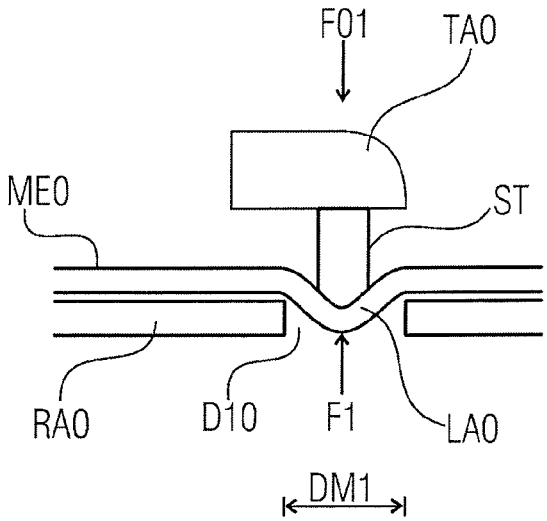
FIGS. 3A-3B show illustrations for explaining the functional principle for setting the return of a button when it is operated.
Figure 3B:
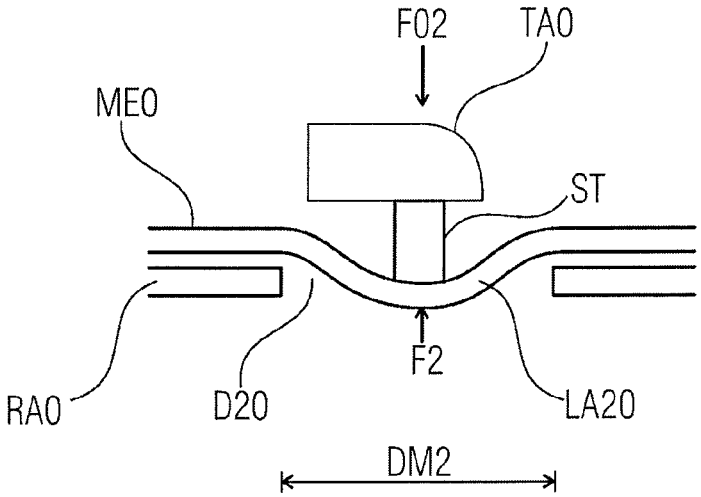

Reference will now be made to FIGS. 3A and 3B in which the return force on the respective bearing section by a diaphragm or the first apertures of a frame which are situated beneath it can be set.

It should first be noted that circular-cylindrical force domes and correspondingly circular first apertures are used in the two embodiments of the invention firstly for simplified illustration and also for the purpose of easy calculation and simulation of return forces. By way of example, FIG. 3A shows a general frame RA0 with a general first aperture D10 which has a first diameter DM1. A general diaphragm ME0 which is supported by the frame RA0 is situated above said aperture. The diaphragm ME0 has a general bearing section LA0 which is situated above the aperture D10. The diaphragm ME0 has a projection, which is generally called tappet ST, in the region of the bearing section. A button TA0 is supported by the tappet ST, said button being arranged above the tappet in the figure.

If a user now operates the button which is arranged above the tappet with a force F01, the tappet as is shown in FIG. 3A is pushed in the direction of the force F01, that is to say in the downward direction in the figure, wherein the bearing section LA0 of the diaphragm ME0 is also moved through the aperture D10 by a movement of the tappet ST downward. In the process, the diaphragm changes shape in the region of the bearing section LA0, wherein this elastic deformation of the flexibly deformable diaphragm generates a return force F1 which counteracts the operating force F01 of the button TA0. Since, in comparison to FIG. 3B, a relatively small region of the bearing section LA0 is deformed, or the deformation has to be effected by a small amount of material of the diaphragm, in the event of the movement of the tappet ST downward, even a small movement of the tappet or deformation produces a relatively large counterforce F1.

In contrast, FIG. 3B (which is substantially identical to FIG. 3A) shows an aperture D20 with a second diameter DM2 which is twice the size of the first diameter DM1 of the aperture D10. If, similarly to the above-described situation in FIG. 3A, a force F02 is exerted by a user in the downward direction in the figure by virtue of a button which is situated above the tappet, the tappet ST is again moved downward in the figure and in the process carries a material section of the diaphragm ME0, which material section is relatively large in comparison to FIG. 3A, corresponding to a relatively large bearing section LA20 downward with it during the movement. In other words, only a small deformation takes place within this bearing section in comparison to the existing material, and therefore the return force F2 is smaller than in FIG. 3A given the same travel or magnitude of the movement of the tappet ST downward.

In this way, it is possible to set the return force and therefore the haptics characteristic curve of a button operation by choosing the diameter of an aperture. Customary forces for operating a button in order to trigger a switching element which is situated beneath it lie in the range of from 5 to 30 N, preferably in the range of from 6 to 15 N.

Figure 4:
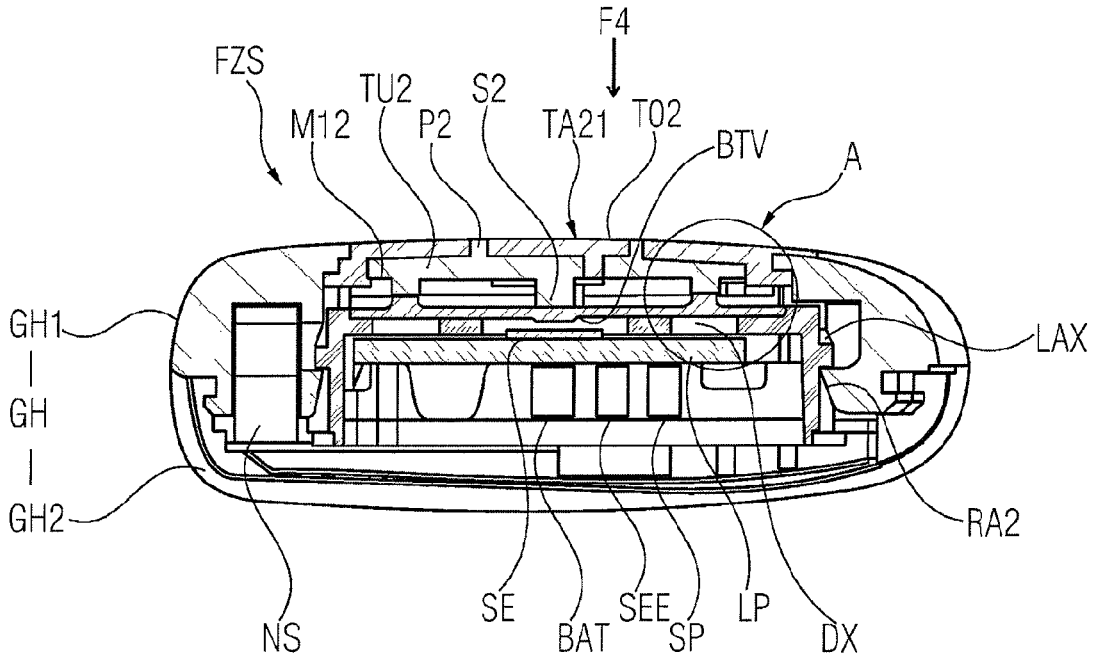
FIG. 4 shows a cross-sectional view of a portable electronic user device in the form of an electronic key according to the second embodiment of the invention.

Reference will now be made to FIG. 4 which shows a schematic cross-sectional view of an electronic key in which an operator control panel or a keypad is provided, said operator control panel or keypad being made up of the buttons from FIG. 1 and the switch housing (comprising diaphragm and frame) of FIG. 2. In this case, the electronic key FZS has a housing GH which comprises two housing sections GH1 and GH2. In addition to a mechanical emergency key NS, the switch housing comprising the frame RA2 on which the diaphragm M12 is supported or mounted is situated within the housing. By way of example, the button TA21 is provided above the diaphragm M12, said button being held by the diaphragm M12 (also see the specific illustration in FIG. 5 in this respect). A printed circuit board LP on which an electrical switching element SE in the form of a microswitch is mounted is situated within the frame RA2, to be precise on that side of the frame RA2 which is opposite the diaphragm M12. Said microswitch SE can be operated or triggered by an operating projection BTV which is situated on the lower side MS2 of the diaphragm M12 in the region of the operating section. Furthermore, a battery BAT which is provided for supplying power to the electronics part FZS is situated in the frame RA2. A transceiver device SEE is also provided, it being possible for said transceiver device to transmit a code, which is stored in an electronic memory SP, to a vehicle-side controller after the switching element SE is triggered.

If the key TA21 is pressed downward in the force direction by a user with the force F4, a button projection or switching tappet S2 will likewise be moved downward in the arrow direction and shift the operating projection BTV of the diaphragm M12 in the direction of the switching element SE and trigger said switching element.

Figure 5:
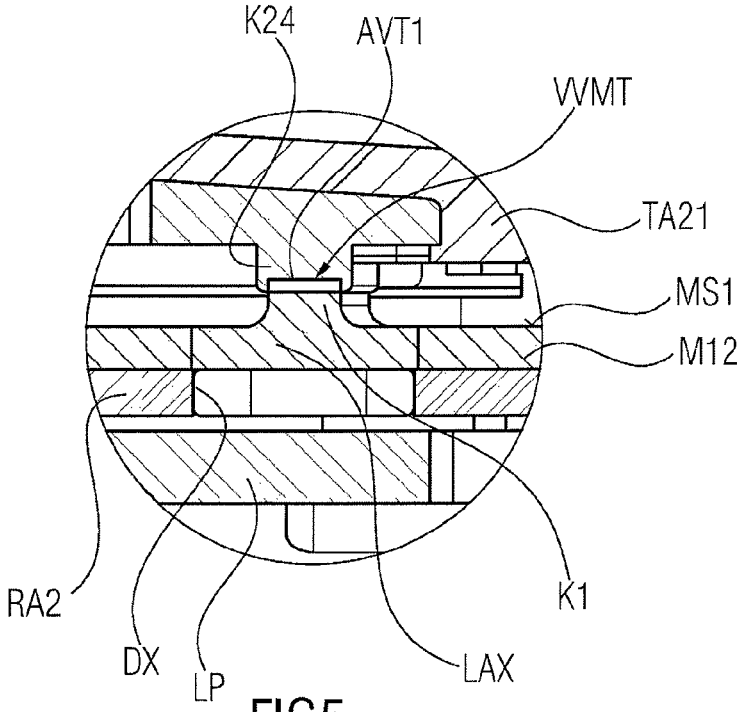
FIG. 5 shows an illustration of a detail of the section which is identified by the letter A in FIG. 4.

In order to generate the counterforce to the operation of the button TA12 with the force F4, the diaphragm M12 has bearing sections LAX, as shown in FIG. 5 which shows a detailed illustration of the region A from FIG. 4.

As shown in FIG. 5, the diaphragm M12 (in the detail shown) has a bearing section LAX which has a diaphragm-side projection or force dome K1 on the first side MS1 of the diaphragm. The button TA21, which has a corresponding button-side projection K24 in the region of the diaphragm-side projection K1, is situated above the diaphragm, wherein the two projections face one another (and the center axes of said projections also coincide). As is further shown in FIG. 5, the diameter of the button-side projection K24 is larger than that of the diaphragm-side projection K1. Furthermore, a recess AVT1 is formed in the button-side projection K24 in such a way that the tip or the upper section of the diaphragm-side projection K1 can be received in said recess AVT1. A mechanical connection VVMT is formed between the two projections in this way. This has the advantage that the two projections cannot shift in relation to one another even in the event of off-center operation of the button TA21 in the case of which the pressure is not exerted perpendicularly or directly in the direction of the projection K1 (perpendicularly downward in the plane of the drawing).

If a force F4 (cf. FIG. 4 in this respect) is exerted perpendicularly downward onto the button TA12, this force will be transmitted by means of the two projections K24 and K1 (which therefore perform the function of a tappet) onto the bearing section LAX which then moves through an aperture DX in the frame RA2 and deforms in the process. The point at which the bearing section LAX strikes the printed circuit board LP which is arranged below the frame RA2 will be the maximum possible deflection or movement of the button TA1 downward.

In summary, it should once again be noted that, owing to the separation of the force function and switching function, there is a large degree of freedom in terms of design when configuring the button sequence, wherein reliable triggering of an electrical switching element is always ensured when the button is operated. Furthermore, targeted setting of the haptics characteristic curve is possible as a result of the size and shape of the first apertures in the frame in the region of the bearing sections of the diaphragm being freely selectable in terms of production. A return force is generated by the diaphragm by defined tensile and pressure loading in the region of the bearing sections with an extremely low friction effect on the button. The force domes can, depending on their length, be dimensioned for the purpose of protecting against an excessively high force since, depending on the length of a force dome, the diaphragm butts more or less quickly against a printed circuit board, which is situated below the frame, when moving through an aperture in the frame, which aperture is situated beneath said diaphragm. Owing to force/travel calculations or simulations, the position of the force domes can be largely freely defined, and therefore a high degree of freedom in terms of design when configuring the printed circuit board and correspondingly further mechanical elements of a portable user device, such as an electronic key, is advantageously
also given with respect to the entire housing. In particular, support or bearing of buttons over a large surface area is possible with a large operating surface, without this having a negative influence on a force/travel characteristic.

The invention claimed is:

1. A portable electronic user device comprising:

one or more dimensionally rigid buttons for operation by a user;

one or more flexibly deformable diaphragms positioned beneath respective ones of the one or more buttons, each flexibly deformable diaphragm comprising:

a first side having at least one bearing section on which the respective button is mounted by a tappet and an operating section which is separate from the at least one bearing section, for receiving and passing on an operation of the respective button to an electrical switching element; and a second side which is situated opposite the first side; and one or more dimensionally rigid frames which support respective ones of the one or more flexibly deformable diaphragms on their second side, wherein each frame has at least one first aperture in the region of the at least one bearing section of the respective diaphragm, it being possible for a section of the second side opposite the bearing section of the respective diaphragm to be moved through said first aperture when the respective button is operated and the respective diaphragm providing a force for returning the button depending on the size and/or shape of the aperture.

2. The user device as claimed in claim 1, in which the tappet is formed by a projection on the first side of the diaphragm in the region of the at least one bearing section.

3. The user device as claimed in claim 1, in which the tappet is formed by a projection of the respective button which interacts mechanically with the at least one bearing section of the respective diaphragm.

4. The user device as claimed in claim 2, in which a mechanical connection is formed between the projection of each diaphragm and a projection of the respective button, in which mechanical connection one of the projections has a receiving section on that section which faces the other projection, it being possible for the other projection to be received in said receiving section.

5. The user device as claimed in claim 1, in which each frame has a second aperture in the region of the operating section of the respective diaphragm, it being possible for the operating section of the respective diaphragm to be moved through said second aperture in order to pass on a button operation to the electrical switching element.

6. The user device as claimed in claim 1, in which each diaphragm has, on the first side, a second projection in the region of the operating section in order to provide an operative mechanical connection to the respective button and/or each button has a second projection for providing an operative mechanical connection to the operating section of the respective diaphragm.

7. The user device as claimed in claim 1, in which each button has an operating surface, wherein, in the state in which the button and the respective diaphragm are assembled, the operating section of the respective diaphragm is situated beneath the geometric center of the operating surface.

8. The user device as claimed in claim 7, in which each diaphragm has at least three bearing sections which span an area beneath the operating surface of the respective button.

9. The user device as claimed in claim 1, in which each diaphragm is fastened onto the respective frame by at least one of adhesive bonding, friction welding, clips, lasers and ultrasound.

10. The user device as claimed in claim 1, in which each diaphragm and the respective frame are in the form of a two-component injection-molded element, in which the diaphragm forms a soft component and the respective frame forms a hard component of the two-component injection-molded element.

11. The user device as claimed in claim 5, in which the electrical switching element is provided on a printed circuit board which is arranged within each frame in such a way that the electrical switching element is situated beneath or within the second aperture.

12. The user device as claimed in claim 2, in which the tappet is formed by a projection of the respective button which interacts mechanically with the at least one bearing section of the respective diaphragm.

13. The user device as claimed in claim 12, in which a mechanical connection is formed between the projection of each diaphragm and the projection of the respective button, in which mechanical connection one of the projections has a receiving section on that section which faces the other projection, it being possible for the other projection to be received in said receiving section.

* * * * *